United States Patent [19]

LaMont

[11] Patent Number: 4,653,829

[45] Date of Patent: Mar. 31, 1987

[54] QUICK CONNECT LAMP SOCKET

[76] Inventor: Romanus M. LaMont, Box F3, Wickenburg, Ariz. 85358

[21] Appl. No.: 822,731

[22] Filed: Jan. 27, 1986

[51] Int. Cl.[4] ..... H01R 4/24

[52] U.S. Cl. ..... 339/97 L; 339/117 R; 339/135; 339/157 C

[58] Field of Search ..... 339/97 R, 97 P, 97 L, 339/98, 99 R, 99 L, 117, 135, 157 C

[56] References Cited

U.S. PATENT DOCUMENTS

| | | | |
|---|---|---|---|
| 761,465 | 5/1904 | Fielding . | |
| 1,013,681 | 6/1912 | Osland et al. . | |
| 1,171,710 | 2/1916 | Freixas | 339/97 L |
| 1,849,846 | 3/1932 | McNeil . | |
| 2,692,374 | 10/1954 | Carson | 339/99 L |
| 2,975,392 | 3/1961 | Ludwig | 339/99 |
| 3,153,119 | 10/1964 | Hart | 174/72 |
| 3,192,499 | 6/1965 | West | 339/91 |
| 3,359,527 | 12/1967 | Hart | 339/59 |
| 3,409,858 | 11/1968 | Krehbiel | 339/91 |
| 3,594,705 | 7/1971 | Levy | 339/97 L |
| 3,867,000 | 2/1975 | Michalak et al. | 339/17 |
| 4,159,157 | 6/1979 | Koehler | 339/97 |
| 4,184,734 | 6/1980 | Toorell | 339/120 |
| 4,262,980 | 4/1981 | Heritage | 339/1 |

*Primary Examiner*—Joseph H. McGlynn

*Attorney, Agent, or Firm*—Cahill, Sutton & Thomas

[57] ABSTRACT

A quick connect lamp socket for rapid connection to a pair of electrical conductors to provide temporary lighting includes a structure that is entirely plastic except for a first rigid conductive member that contacts the threads of a screwed-in light bulb and a second rigid conductive member that contacts the center conductor of the light bulb. Each of the first and second conductive members have sharp edges that cut through the insulation of the cable as the conductors of the cable are pressed against the edges. A pair of pivotally connected arms function as levers having pads that press the insulated cable conductors against the cutting edges of the first and second conductive members. A cap pressed on the device retains the insulated conductors in place. The arms pivot to lock together and form a hook through which a cable can extend to support the quick connect socket.

11 Claims, 8 Drawing Figures

QUICK CONNECT LAMP SOCKET

BACKGROUND OF THE INVENTION

Temporary electrical lighting is frequently required at construction sites, fenced-in storage areas, carnivals, and numerous large areas. Typically, a support cable is strung around the area to be lighted, and various electrical sockets, spaced at suitable intervals, are supported by the cable. Electrical power conductors are electrically connected to the sockets. U.S. Pat. Nos. 761,465, 1,013,681, 1,849,846, 2,975,392, 3,153,119, 3,192,499, 3,359,527, 3,409,858, 3,867,000, 4,159,157, 4,184,734, and 4,262,980 are generally indicative of the state-of-the-art. Typically, such sockets must be of very low cost, must meet OSHA safety requirements, must be usable in all weather conditions, and must be rated at fairly high wattages, for example at 200 watts.

Most of the quick connect socket structures shown in the above-indicated references are too complex and therefore too expensive to meet the requirement of low cost demanded the market. Some of the prior devices, such as the one of U.S. Pat. No. 761,465, have sharp pointed conductors that penetrate the insulation of conductors to electrically contact the metal inner conductors and thereby supply electrical power to the bulb screwed into the quick connect socket. The electrical contact thereby achieved by the pointed probes is unreliable, and such pointed probes are illegal in some states.

There is an unmet need for a highly reliable, weatherproof, lower cost quick connect lamp socket that can be easily installed on a support cable strung around an area requiring outdoor and/or temporary lighting and which can be easily connected to the insulated conductors of an electrical cable that supplies power to the quick connect sockets.

BACKGROUND OF THE INVENTION

Accordingly, it is an object of the invention to provide a very low cost, easily manufacturable, weatherproof, easily installed quick connect lamp socket.

Briefly described, and in accordance with one embodiment thereof, the invention provides a quick connect lamp socket composed of two molded plastic parts including two half barrel socket body sections that snap together, a pair of curved arms attached in hinged relationship to tabs of the half body sections, a plastic cover, and a first rigid conductive member having an elongated portion that extends along an inner, threaded portion of the socket for contacting the threads of a screwed-in light bulb, and a second rigid conductive member for connecting the center electrode of the screwed-in bulb. Each of the first and second rigid conductive members has a sharp edge that cuts into insulation of first and second electrical conductors, respectively, of the electrical cable supplying power to the screwed-in bulbs. Each of the curved arms includes a bifurcated pad with concave surfaces for engaging the insulated conductors and forcing them into contact with the first and second rigid conductive members such that the first and second conductors cut through the insulation and contact the metal center conductors within the insulation. The curved arms have upper end portions that lock together to form a loop through which a support cable passes. A weatherproof cover is retained in place by the pivotal arms when they are locked in place to form the loop. Spaced posts inside the cover retain the insulated cables in electrical communication with the first and second conductors, and the bifurcated pads retain the cover in place when outer ends of the two curved arms are locked together.

DESCRIPTION OF THE INVENTION

Figure 1:
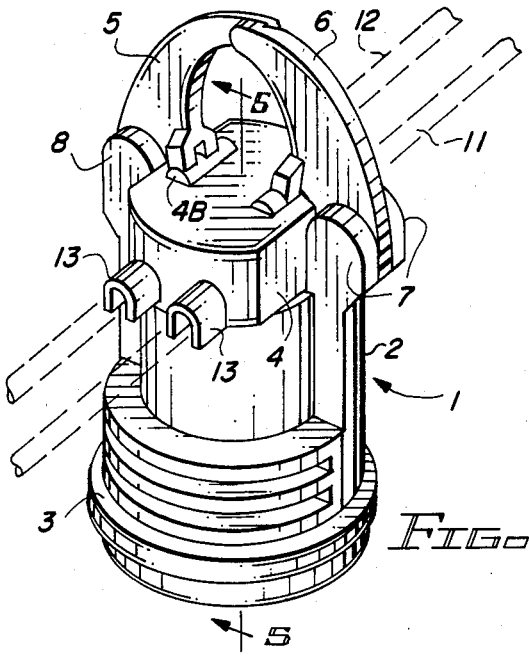
FIG. 1 is a perspective view of the assembled quick connect lamp connector of the present invention.

Referring now to the drawings, quick connect lamp socket 1 includes a split socket housing 2 enclosing a bulb-receiving threaded socket 14. Reference numeral 15 designates the threads of socket 14 with which the metal threads of a screwed-in bulb mate. In accordance with the present invention, the socket housing 2 is composed of plastic, such as polypropylene or polycarbonate.

Figure 8:
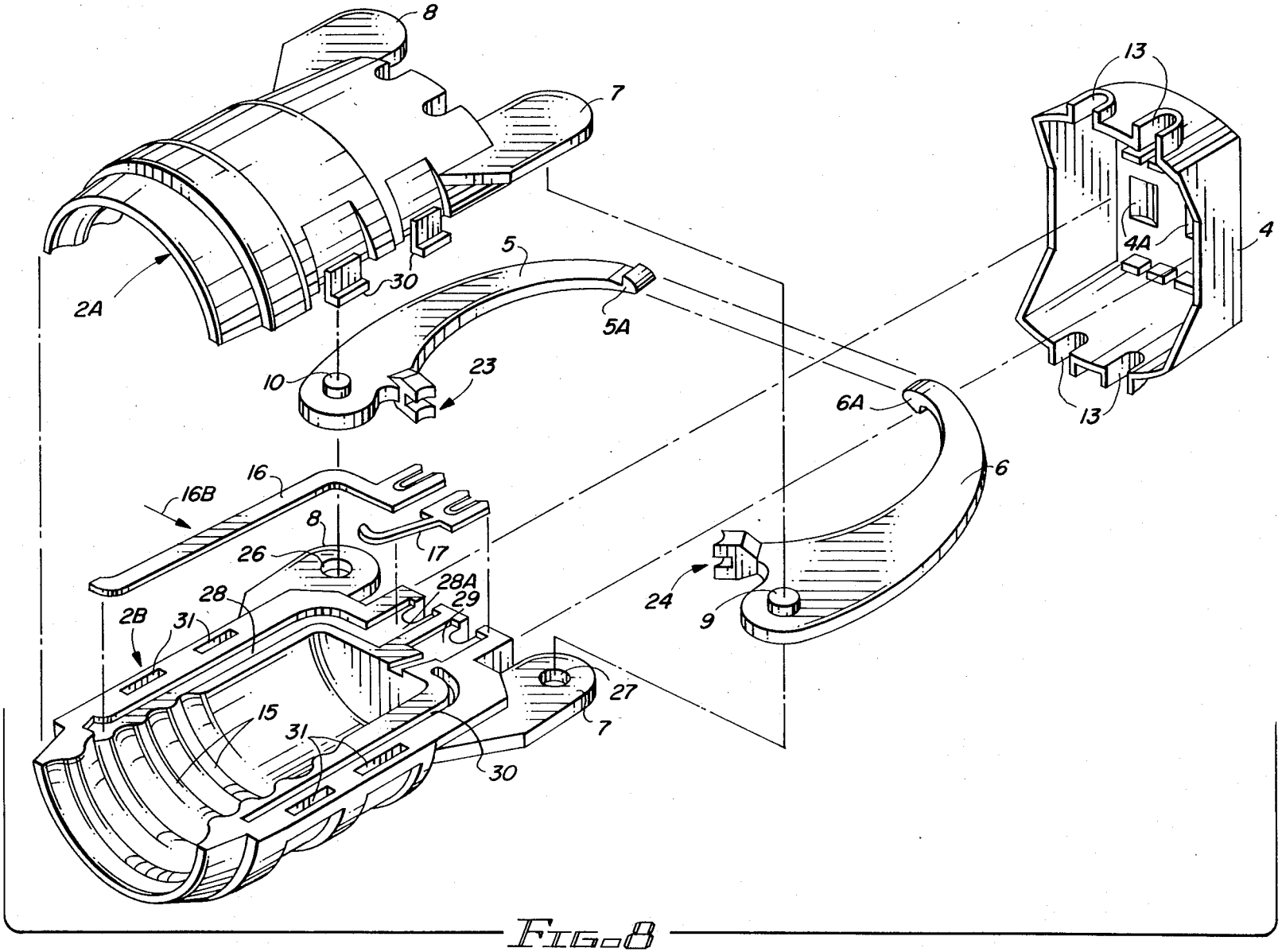
FIG. 8 is an exploded perspective view of the quick connect lamp socket of FIG. 1.

As best seen in FIG. 8, socket housing 2 includes a half barrel section 2A and a half barrel section 2B that snap fit together by means of male snap elements 30 of section 2A which snap fit into female openings 31 of section 2B.

An annular shoulder 3 is disposed about the lower portion of housing 2 to support a suitable plastic bulb guard (not shown) that can be attached to lamp socket 1 after a light bulb is screwed into socket 14. Various suitable plastic bulb guards, such as a PLASGARD model manufactured and marketed by the present inventor, are readily available.

Each of sections 2A and 2B of socket housing 2 include a first post 7 and a second post 8. A first curved arm 5 is pivotally disposed between posts 8. A second curved arm 6 is pivotally disposed between posts 7. The outermost ends of arms 5 and 6 have snaplocking members or pads 5A and 6A, respectively. Arm 5 has, at its lower section, a pair of integral pins 10 disposed on opposite sides thereof for fitting into holes such as 26 in the inner faces of posts or tabs 8. Similarly, a pair of opposed pins 9 are disposed on opposite sides of the lower end of arm 6 and extend into holes 27 of posts or tabs 7.

Arm 5 has a pair of bifurcated, concave surfaced pads 23 that are utilized to engage and press an insulated electrical conductor 12 into a recess 18 (FIGS. 2 and 3) when arm 5 is pivoted inward (clockwise) as far as possible when arm 6 is positioned out of the way, so that sharp, parallel, inner spaced edges of a bifurcated end of a first conductive member 16 cut through the outer insulation of electrical conductor 12 and make reliable electrical contact to the metal center conductor 13 thereof.

Similarly, arm 6 has a pair of bifurcated, concave surfaced pads 24 that engage and press an insulated electrical conductor 11 into groove 19 and between sharp parallel spaced edges of a bifurcated end of a second rigid conductive member 17 when are 6 is pivoted inward (counter clockwise) as far as possible, with arm 5 positioned out of the way, so as to cut through the insulation of conductor 12 and make reliable electrical contacts to the metal center conductor 12A of insulated cable 17.

A waterproof cover 4 having two pairs of opposed awnings 13 through which the electrical conductors 11 and 12 pass is pressed over posts 20, 21, and 22 of quick connect lamp socket 1. Grooves 18 and 19 are formed between posts 20, 21, and 22. (See FIGS. 2 and 3 especially.)

Figure 4:
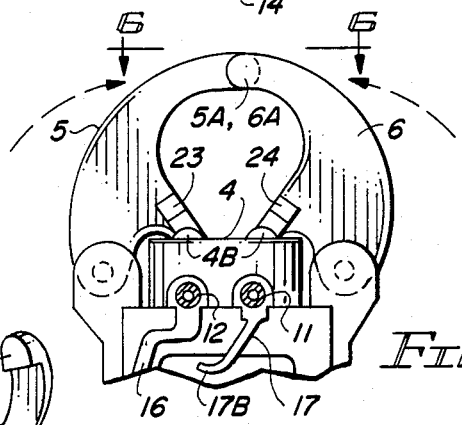
FIG. 4 is a partial section view useful in illustrating locking the ends of the curved arms of the quick connect lamp socket together.

After cover 4 is pressed into place, arms 5 and 6 pivot together as indicated by the arrows in FIG. 4. Snap locking members 5A and 6A engage so that curved arms 5 and 6 form a supporting loop through which a cable or rope can extend to support a large number of the quick connect lamp sockets 1, together with the electric light bulbs and bulb shields connected thereto. The electrical conductors 11 and 12 are supported by quick connect lamp socket 1, and hence the support cable or rope extending through the loop formed by closed arms 5 and 6.

Figure 3:
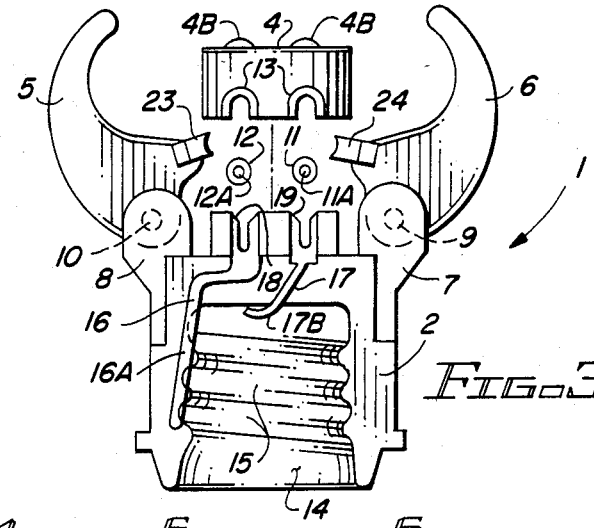
FIG. 3 is a section view of the quick connect lamp connector of FIG. 1.

As best seen in FIG. 3, first rigid conductive member 16 has an elongated straight section 16A that extends partly into the grooves formed by threads 15 of socket 14, so that when the conductive, threaded base electrode of an electric light bulb is screwed into socket 14, portion 16A engages the metal threads of the light bulb base electrode. The material of conductive member 16 is slightly elastic, so that as the light bulb is screwed into the socket opening 13, section 16A of conductive member 16 is "spring loaded" against the threaded base of the bulb in the direction of arrow 16B of FIG. 8. This ensures reliable electrical contact thereto. The upper portion of first rigid conductive member 16, which can be composed of full tempered brass has the above-mentioned bifurcated end section including two "fingers" each having a sharp inner edge and defining a narrow groove, the width of which is slightly less than the diameter of the metal center conductor 12A of electrical conductor 12. Thus, when insulated conductor 12 is forced into the groove between the bifurcated fingers at the upper end of metal element 16, the inner edges of the bifurcated fingers cut through the insulation and make reliable electrical contact with the metal center conductor 12A.

Similarly, the upper end of second rigid conductive member 17 also has precisely the same upper bifurcated finger configuration as metal conductor 16. The lower portion of conductive member 17 extends to the center of the top of socket 14, and has a curved section 17B that contacts the center electrode of the screwed-in light bulb (not shown). The structure of the bifurcated upper finger section of metal conductor 17 is shown in an enlarged section view in FIG. 6, wherein it can be seen that the sharp inner edges 17C of the bifurcated fingers 17 cut through the insulation 12B of insulated electrical conductor 11 and make reliable electrical contact with the metal center conductor 11A thereof.

Figure 5:
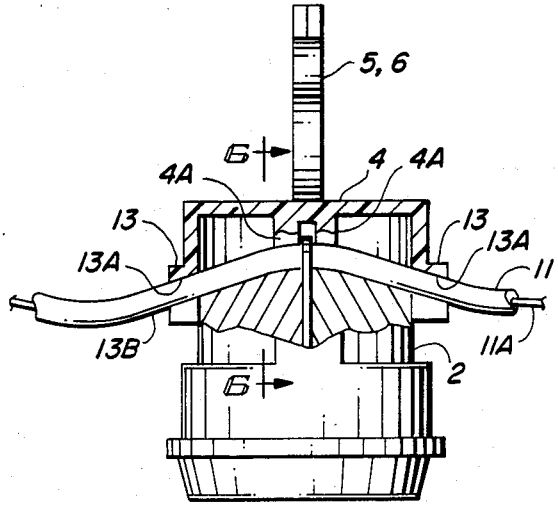
FIG. 5 is a partial cutaway section view illustrating the retention of the insulated electrical cable by the cap of the device.
Figure 6:
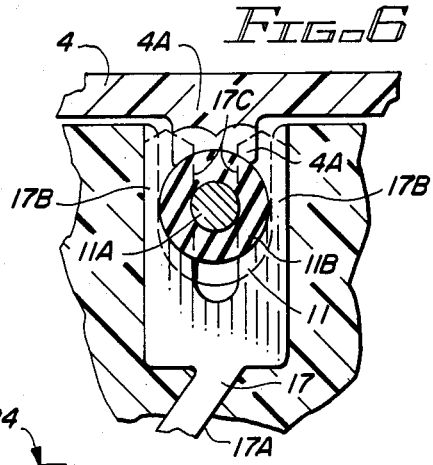
FIG. 6 is a partial section view taken along section lines 6—6 of FIG. 1 5.
Figure 7:
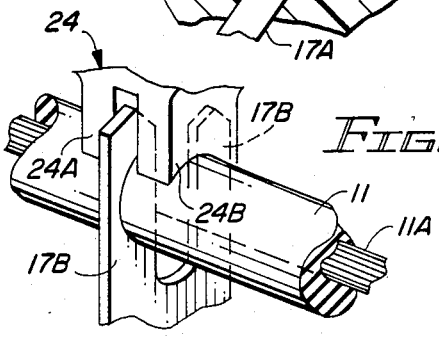
FIG. 7 is a partial perspective view illustrating the forcing of the insulated electrical cable between bifurcated prongs of one of the inner conductors of the quick connect lamp socket.

As shown in FIGS. 5 and 6, the inside upper surface of cover 4 has attached thereto two sets of spaced posts 4A, each having a concave lower surface, which retain the insulated electrical conductor 12 tightly in groove 19 and tightly between the bifurcated upper finger 17B of metal conductor 17. Posts 4A disposed on the inner roof surface of cover 4 also are shown in FIG. 8.

As shown in FIGS. 1, 3, and 4, the upper surface of cover 4 includes two elongated, semi-cylindrical ridges or bumps 4B which mate with the concave surfaces of the pads of the bifurcated ends 23 and 24 so that the cover 4 is tightly retained in the configuration shown in FIG. 4 when the outer ends of curved arms 5 and 6 are snapped together, as shown in FIG. 4. Slightly downwardly sloped awnings 13 press downward on the exiting portions of conductors 11 and 12, tending to retain conductors 11 and 12 in place in grooves 19 and 18, respectively, especially if the conductors 11 and 12 are stiff. The downward sloped surfaces 13B (FIGS. 2 and 5) allows any moisture accumulated inside the cover 4 to gradually leak out.

The exploded view shown in FIG. 8 more clearly shows the male snap lock members 30 and the female holes 31 by means of which the two half barrel sections 2A and 2B are snapped together. Slots 28, into which the first rigid conductive member 16 fits, also is clearly illustrated in FIG. 8. The bifurcated upper end section fits in portion 28A of groove 28. Second rigid conductive member 17 fits into slot 29. Groove 30 mates with a corresponding ridge (not shown) along the mating edge of upper half barrel section 2A to facilitate precise alignment of the upper and lower half barrel sections 2A and 2B.

Figure 2:
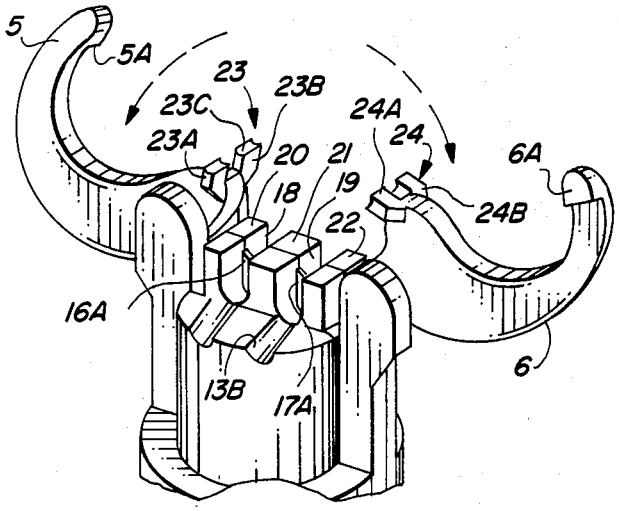
FIG. 2 is a partial perspective view of the quick connect lamp connector of FIG. 1 with its lid removed and its curved pivot arms separated.

In order to install a large number of quick connect lamp sockets 1 along a pair of insulated electrical conductors such as 11 and 12, a user merely pivots the arms 5 and 6 outward, as shown in FIG. 2, removes the cover 4, positions one of the conductors in groove 18, pivots arm 5 clockwise as far as it will go so that the concave lower surfaces 23C of bifurcated pads 23A and 23B press that conductor as far down into groove 18 as it will go, and retracts arm 5 to the configuration shown in FIG. 2. A significant advantage of the structure of the invention is that the user can determine by visual inspection whether the sharp edges of the bifurcated ends of conductive members 16 and 17 cut through the insulation of the electrical conductors.

The foregoing procedure is repeated for the other conductor, placing it in groove 19 and pivoting arm 6 as far counterclockwise as it will go. Cover 4 then is placed to cover posts 19, 20 and 22 and the portions of conductors 11 and 12 within groves 18 and 19 as shown in FIG. 4. The two arms 5 and 6 are then snapped together around the support rope or cable, as shown in FIG. 4. This is repeated as often as is necessary to provide the desired number of quick connect lamp sockets at the desired spacing along the electrical conductors.

Thus, the quick connect sockets of the invention can be quickly and safely installed without the use of tools, with no danger of electrical shock to the installer. The device is equally effective for attachment to electrical conductors of various thicknesses.

While the invention has been described with reference to a particular embodiment thereof, those skilled in the art will be able to make various modifications to the described embodiment of the invention without departing from the true spirit and scope thereof. For example, various other snap locking elements than those disclosed could readily be used.

I claim:

1. A quick connect lamp socket comprising in combination:

(a) a threaded socket housing for receiving the threads of a light bulb;

(b) first and second curved arms pivotally connected to the socket housing;

(c) first and second spaced, parallel grooves disposed in the socket housing between the first and second curves arms;

(d) first and second extensions attached to the first and second curved arms, respectively, the first extension moving into the first groove when the first arm is pivoted toward the first groove, the second extension moving into the second groove when the second curved arm is pivoted toward the second groove:

(e) a first conductive member extending into the socket of the socket housing and engaging metal threads of a light bulb screwed into the socket housing, the first conductive member having a sharp section extending into the first groove;

(f) a second conductive member extending into the socket to engage a center electrode of the light bulb and having an upper sharp portion extending into the second groove; and (g) first and second locking elements attached to the outer ends of the first and second curved arms, respectively, to lock the outer ends of the first and second curved arms together when they are pivoted toward each other, thereby forming a support loop by means of which the lamp socket can be supported by a cable or the like extending through the support loop.

2. The quick connect lamp socket of claim 1 wherein the first rigid conductive member includes an elongated lower section that extends into the deepest portions of the grooves forming the threads into which the light bulb is screwed.

3. The quick connect lamp socket of claim 1 wherein the upper portions of the first and second conductive members each are bifurcated and include first and second spaced parallel fingers with sharp inner edges, the distance between the sharp inner edges being less than the diameter of metal conductors of insulated conductors forced into the first and second grooves.

4. The quick connect lamp socket of claim 3 wherein the first and second extensions each include a pair of spaced, concave surfaced pads that extend into the groove on either side of the fingers of the first and second conductive members, respectively.

5. The quick connect lamp socket of claim 4 including a waterproof cover having inner posts that retain the insulated conductors in the first and second grooves when the cover is in place on the socket housing.

6. The quick connect lamp socket of claim 5 wherein the first and second extensions retain the cover in place on the socket housing when the first and second snap lock elements are engaged with each other.

7. The quick connect lamp socket of claim 6 wherein the socket housing includes first and second downwardly sloped, oppositely sloped concave surfaces for supporting the insulated conductors and allowing moisture to drain out of the first and second grooves.

8. The quick connect lamp socket of claim 6 wherein the cover includes two pairs of opposed awning structures that cover the first and second insulated conductors and provide tunnels through which the first and second conductors pass as they pass through the first and second grooves.

9. The quick connect lamp socket of claim 1 wherein the socket housing, first and second curved arms, cover, and first and second extensions are composed entirely of plastic.

10. The quick connect lamp socket of claim 9 wherein the first and second curves arms are journaled between first and second pairs of posts attached to an upper portion of the socket housing.

11. The quick connect lamp socket of claim 10 wherein the socket housing is composed of first and second half barrel sections and snap lock elements by means of which the first and second half barrel sections can be connected together, and wherein the first and second curved arms are integral with the first and second extensions and the first and second snap locking means, respectively, wherein the first and second curved arms further include integral pivot pins that are surrounded by holes in the posts of the socket housing when the first and second barrel sections are snapped together.

* * * * *